US006626487B1

(12) United States Patent
Buitendach

(10) Patent No.: US 6,626,487 B1
(45) Date of Patent: Sep. 30, 2003

(54) BABY CHAIR

(76) Inventor: Johan Nicolaas Buitendach, Cnr Hardy Muller & Frans du Toit Streets, Rosslyn (ZA), 0200

( * ) Notice: Subject to any disclaimer, the term of this patent is extended or adjusted under 35 U.S.C. 154(b) by 0 days.

(21) Appl. No.: 09/926,443

(22) PCT Filed: May 4, 1999

(86) PCT No.: PCT/ZA99/00030

§ 371 (c)(1),
(2), (4) Date: Mar. 8, 2002

(87) PCT Pub. No.: WO00/65965

PCT Pub. Date: Nov. 9, 2000

(51) Int. Cl.[7] ..... A47B 39/00
(52) U.S. Cl. ..... 297/153; 297/467
(58) Field of Search ..... 297/DIG. 2, 467, 297/451.11, 151, 148, 149, 153

(56) References Cited

U.S. PATENT DOCUMENTS

| | | | | |
|---|---|---|---|---|
| 5,183,311 | A | | 2/1993 | Meeker et al. |
| 5,183,315 | A | | 2/1993 | Takahashi et al. |
| 5,951,102 | A | * | 9/1999 | Poulson et al. |
| 5,992,932 | A | * | 11/1999 | Kain et al. |

FOREIGN PATENT DOCUMENTS

| | | |
|---|---|---|
| EP | 0 908 124 | 4/1999 |

* cited by examiner

*Primary Examiner*—Milton Nelson, Jr.
(74) *Attorney, Agent, or Firm*—Jacobson Holman PLLC

(57) ABSTRACT

A baby supporting chair which comprises a seat, a backrest, two side supports, a front support and between the front support and the side supports two grooves for the baby's legs to project outwardly from the seat, characterised in that the seat of the chair is at a level equal to or lower than the level of the bottoms of the two grooves.

3 Claims, 3 Drawing Sheets

BABY CHAIR

This is a nationalization of PCT/ZA99/00030 filed May 4, 1999 and published in English.

TECHNICAL FILED

The present invention relates to baby chairs.

Baby chairs are in general known to applicant, in connection with high chairs and low chairs for feeding babies; these have a tray or small table top attached. Chairs which have a hole for a baby chamberpot are known which ease the use of chamberpots in the toilet training of babies.

None of these products, however, address the problem with which the present invention is concerned.

BACKGROUND ART

The present invention is concerned with the problem with small or young babies which can not sit up without assistance or not sit up safely. This is the case with many typical babies up to the age of between 6 and 7 months, although there is considerable variation between babies. With babies that can not yet sit up or can not yet sit up safely, there comes a stage when mothers often wish for various reasons to be able to support the baby in a sitting position without having to do it by holding the baby in this position in the mother's arms. Though this is a personal question of course, examples are when the mother wishes to feed the baby or to allow it look around to satisfy its developing interest in its surroundings, instead of the baby becoming bored and crying as a result. Mothers sometimes therefore resort to propping up a baby with pillows or cushions, not always effective and generally not safe.

The solution of this problem in accordance with the present invention is a baby supporting chair which comprises a seat, a backrest, two side supports, a front support and between the front support and the side supports two grooves for the baby's legs to project outwardly from the seat, characterised in that the seat of the chair is at a level equal to or lower than the level of the bottoms of the two grooves.

The chair is preferably moulded or otherwise formed integrally and preferably from a soft yet supportive material. An example which fulfils these preferred features is a suitable grade of polyurethane, integrally moulded. The chair is desirably moulded with rounded contours, especially avoiding any projecting or convex shapes which are sharp or angular or present corners which could hurt a baby or produce discomfort.

A preferred embodiment has formations to which a small tray or table top can be attached removably, when required. These formations are preferably indentations or concave formations which then can not produce any possibly harmful projections.

BRIEF DESCRIPTION OF THE DRAWINGS

The invention will be more fully described by way of example, with reference to the accompanying drawings, in which.

Figure 1:
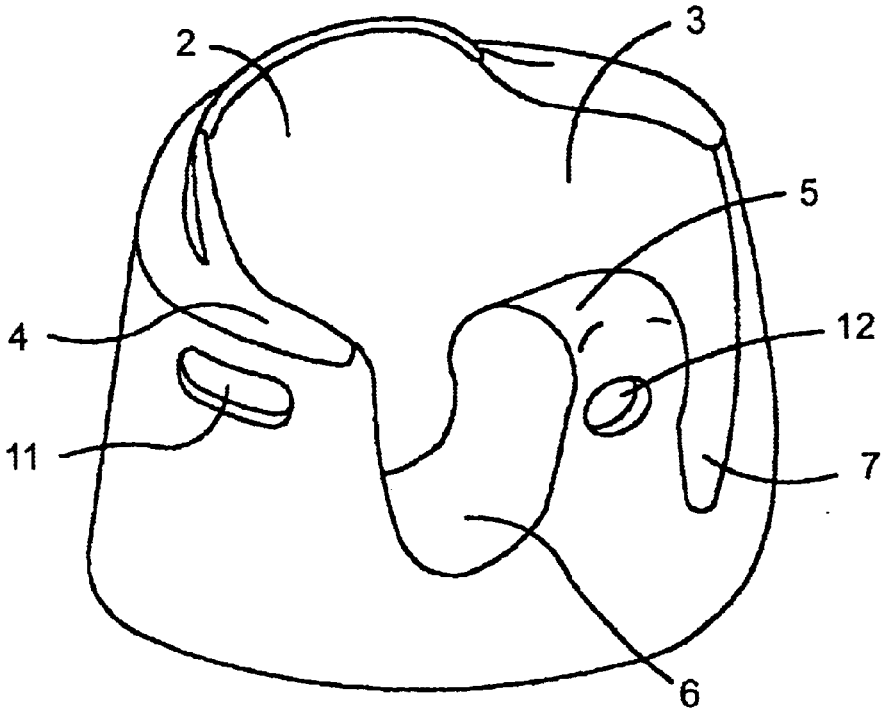
FIG. 1 is an isometric view of a baby supporting chair.

As shown in the drawings, the baby supporting chair comprises a seat 1, a backrest 2, two side supports 3 and 4, a frontal support 5 and two grooves 6 and 7 for the baby's legs. The characterizing feature of the chair is that the seat is located at a level 8 which is lower than the level 9 of the bottoms of the two grooves.

The seat is integrally moulded from a suitably chosen grade of polyurethane, to give a certain softness to the touch but also to have a sufficient structural stability to support a baby, in this design. For this stability the moulding includes ribs 10. As is known in the art of moulding polyurethane, this material has a feature that it moulds with a closed outer skin but an inner region of porous nature. The skin enables effective cleaning and the inner porous structure confers a yielding property or softness to the outer surfaces which is comfortable for a baby. The choice of polyurethane grade is made according to known standards and criteria.

The outer sides of the chair have formations 11 formed in them (visible in FIG. 1 only on the near side but present also on the far side) and a groove on the outside of the front support. The formations are indented grooves which are there for attaching a tray in a removable fashion.

Figure 2:
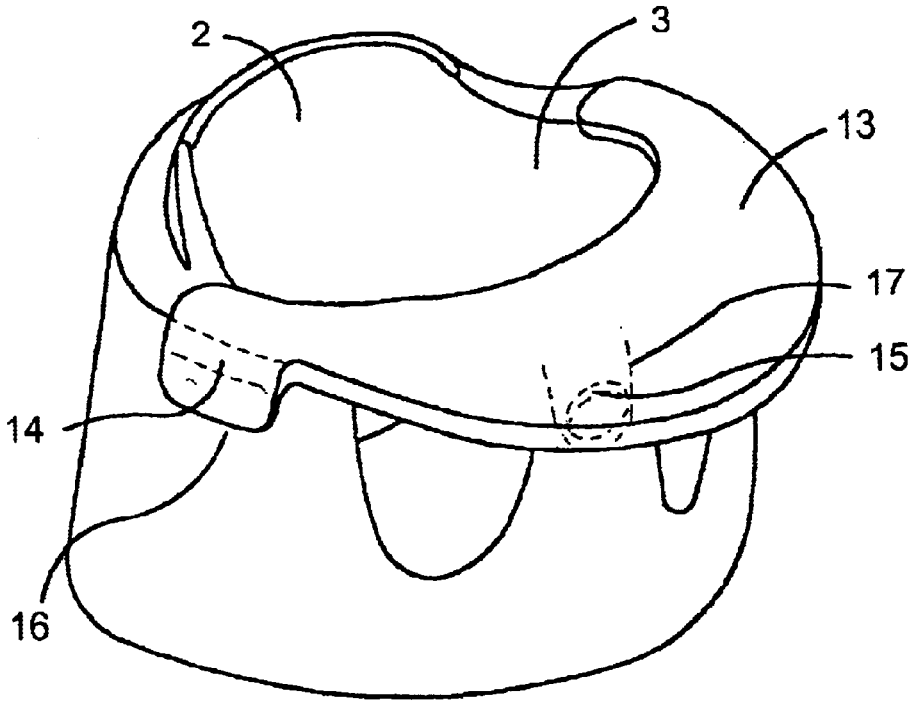
FIG. 2 is an isometric view of the baby chair with a small tray added.
Figure 3:
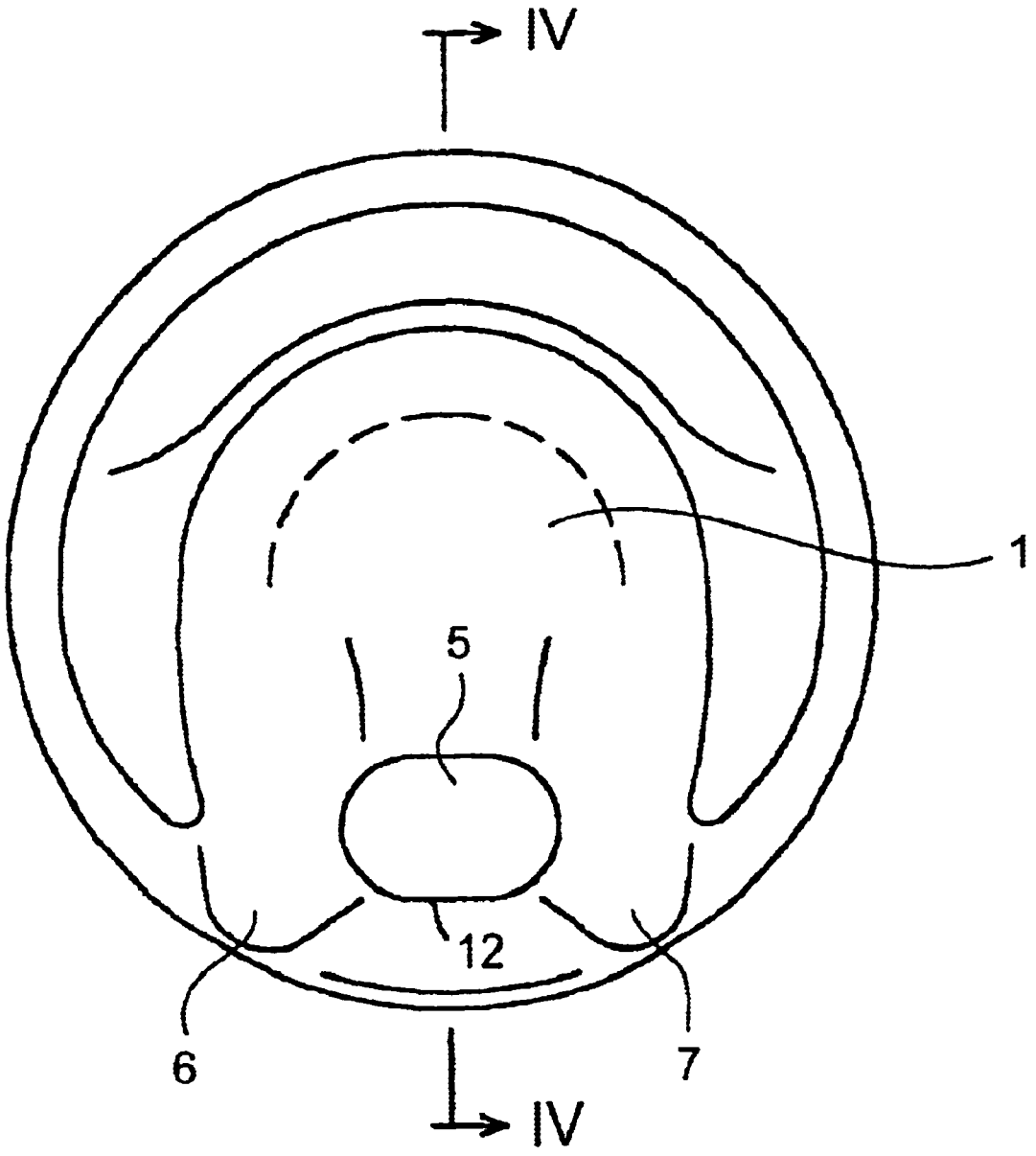
FIG. 3 is a plan view of the chair.
Figure 4:
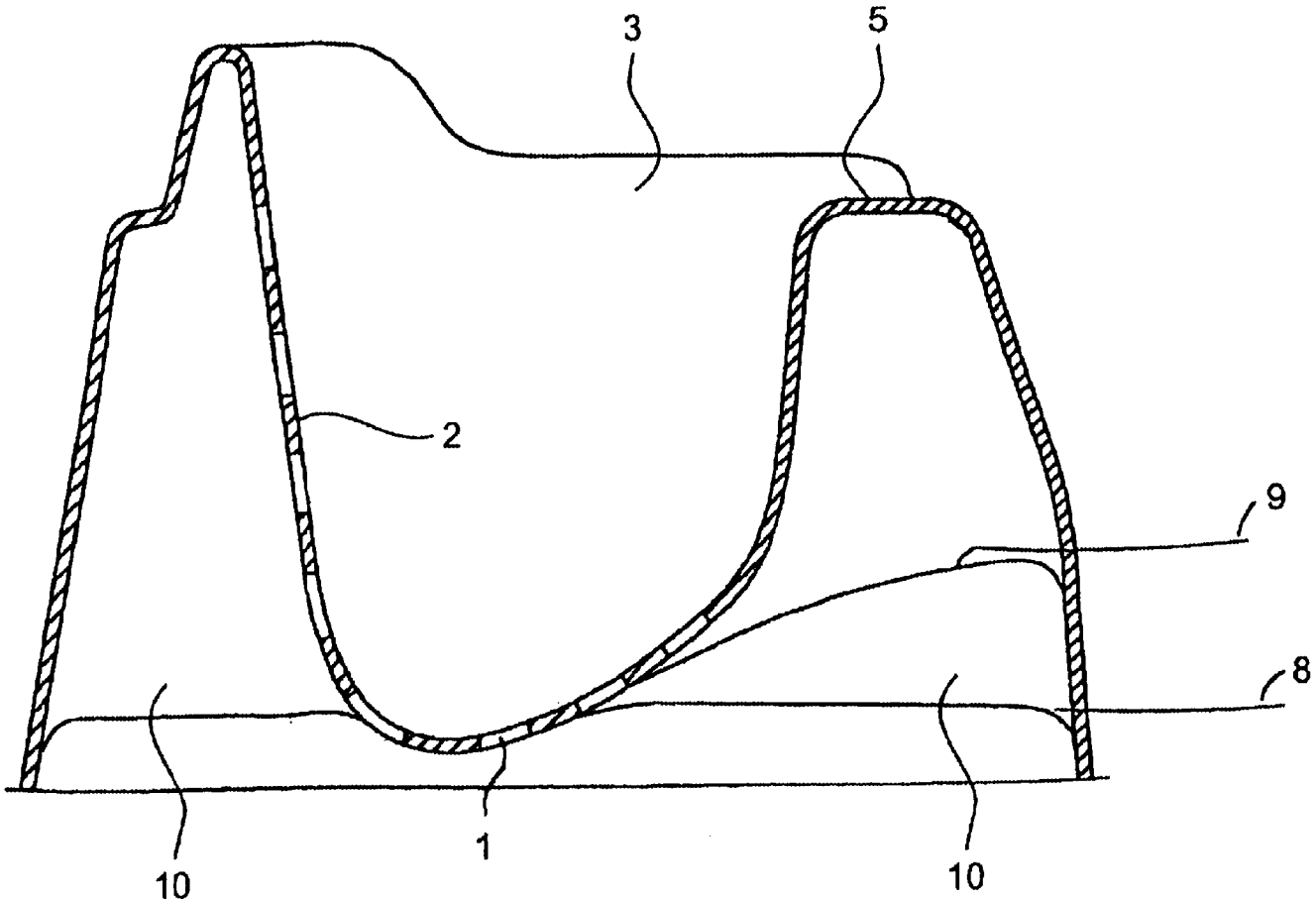
FIG. 4 is a cross sectional side elevation of the chair on section IV—IV shown in FIG. 3.

FIG. 2 shows a tray 13 attached to the seat by having protuberances indicated by broken lines 14 and 15 in FIG. 2, engage in the grooves 11 and 12 seen in FIG. 1. The protuberances 14 are located on inner surfaces of tabs 16 on either side of the tray and protuberances 15 are located on inner surfaces of a tab at the front and underneath the tray, indicated by broken lines 17 in FIG. 2. Springiness of the tabs of the tray allow the protuberances to enter the grooves with a click action and be retained there against any forces which a baby might exert but to be easily removable by an adult.

The tray also has edges which are rounded so as to form no sharp edges or corners which could hurt a baby.

What is claimed is:

1. A baby supporting chair which comprises a seat, a backrest, two side supports, a front support, two grooves between the front support and the side supports for the baby's legs to project outwardly from the seat, the seat of the chair being at a level lower than a level of bottoms of the two grooves, and indented grooves, located on outer surfaces of the two side supports and a front side of the chair, for removable attachment of a tray, the seat being molded from a suitably selected grade of polyurethane to give a certain softness to touch but also to have a sufficient structural stability to support a baby, with a closed outer skin which enables effective cleaning and integrally an inner porous structure which confers a yielding property and softness which is comfortable for a baby.

2. The baby supporting chair as claimed in claim 1, provided in combination with a tray which has tabs with protuberances on inner surfaces of the tabs and located to be able to engage the indented grooves on said outer surfaces of the chair.

3. A baby supporting chair which comprises a seat, a backrest, two side supports, a front support, two grooves between the front support and the side supports for the baby's legs to project outwardly from the seat, the seat of the chair being at a level lower than a level of bottoms of the two grooves, and a single indented groove located on an outer surface of each of the two side supports and a front side of the chair, for removable attachment of a tray, the seat being molded from a suitably selected grade of polyurethane to give a certain softness to touch but also to have a sufficient structural stability to support a baby, with a closed outer skin which enables effective cleaning and integrally an inner porous structure which confers a yielding property and softness which is comfortable for a baby.

* * * * *